United States Patent [19]

Heijnen et al.

[11] 4,248,633

[45] Feb. 3, 1981

[54] UNIVERSAL COPPER-PLATING SOLUTION

[75] Inventors: Godefridus H. C. Heijnen; Arian Molenaar, both of Eindhoven, Netherlands

[73] Assignee: U.S. Philips Corporation, New York, N.Y.

[21] Appl. No.: 59,797

[22] Filed: Jul. 23, 1979

Related U.S. Application Data

[63] Continuation of Ser. No. 852,606, Nov. 18, 1977, abandoned, which is a continuation of Ser. No. 755,434, Dec. 29, 1976, abandoned, which is a continuation of Ser. No. 550,361, Feb. 18, 1975, abandoned.

[30] Foreign Application Priority Data

Feb. 22, 1974 [NL] Netherlands ..... 7402422

[51] Int. Cl.[3] ..... C23C 3/02

[52] U.S. Cl. ..... 106/1.23; 106/1.26; 427/437

[58] Field of Search ..... 106/1.23, 1.26; 427/437

[56] References Cited

U.S. PATENT DOCUMENTS

| | | | |
|---|---|---|---|
| 3,663,242 | 5/1972 | Gulla et al. | 106/1.23 |
| 3,718,465 | 2/1973 | Ekman | 96/48 PD |

FOREIGN PATENT DOCUMENTS 1187861 4/1970 United Kingdom .

*Primary Examiner*—Lorenzo B. Hayes

*Attorney, Agent, or Firm*—Norman N. Spain

[57] ABSTRACT

A copper-plating bath suitable for reprographic uses and for making electrically conducting metal patterns with one of the redox pairs $V^{2+}/V^{3+}$, $Ti^{2+}/Ti^{3+}$, or $Cr^{2+}/Cr^{3+}$ as a reducing agent, ascorbic acid with an acid acceptor, or the redox pair $Fe^{2+}/Fe^{3+}$ together with an organic carboxylic acid and a complexing agent for cuprous ions.

4 Claims, No Drawings

UNIVERSAL COPPER-PLATING SOLUTION

This is a continuation, of application Ser. No. 852,606, filed Nov. 18, 1977 and now abandoned, said application Ser. No. 852,606 in turn being a continuation of application Ser. No. 755,434, filed Dec. 29, 1976 and now abandoned and said application Ser. No. 755,434 being a continuation of application Ser. No. 550,361 filed Feb. 18, 1975 and now abandoned.

The invention relates to a universal copper-plating solution which may be used both as a physical copper developer and for intensifying images consisting of external photographic nuclei to copper patterns without an external current source. Such a solution may be used both for reprographic purposes and for the manufacture of printed circuits, conducting coatings which are further electrolytically coated, and also for decorative purposes.

Electroless copper-plating solutions are known in which formaldehyde is used as a reducing agent. The high pH values of these solutions are a drawback with a view to the risk of attack of the substrate material while in addition photographically obtained images consisting of silver and silver amalgam nuclei cannot be intensified by such solutions without an extra treatment.

Such an alkaline bath is known from U.S. Pat. No. 3,095,309 with which satisfactory ductile copper can be deposited. This bath contains an inorganic cyanide and/or an organic nitrile as a complex forming agent for cupric ions. Due to this addition the structure of the deposit and the stability of the solution are improved.

Physical copper developers with which photographic nuclei images can be intensified to a sufficient final density are preferred to physical silver developers, not only because copper is cheaper than silver, but particularly because copper has a much greater absorption in the ultraviolet part of the spectrum. As a result images which are developed thereby are eminently suitable as photomask material and for reprographic uses.

Physical copper developers are known from U.K. Pat. No. 1,187,861 with which copper can be deposited in a strongly acid medium on images, consisting of silver or silver amalgam nuclei with the aid of the $V^{2+}/V^{3+}$, the $Ti^{2+}/Ti^{3+}$ or the $Cr^{2+}/Cr^{3+}$ redox system. Physical copper developers are also known in which $Fe^{2+}/Fe^{3+}$ in an alkaline medium with a mixture of ethylenediaminetetraacetic acid and triethanolamine operates as a reducing agent. A drawback of such a bath is that its production of metal-hydroxide causing instability.

A drawback of the solutions according to the latter patent is that much cuprous oxide is deposited during reduction to copper metal in the solution. The stability of these solutions is therefore very poor. Since much cuprous oxide is enclosed in the deposit, the quality of the developed images is not very satisfactory.

Another bath for intensifying images consisting of photographically obtained nuclei with copper is described in U.S. Pat. No. 3,512,972 the contents of which are hereby incorporated by reference. In this bath ascorbic acid is used in combination with a nitrogen-containing acid acceptor, for example, an amine as the reduction system for cupric ions. Likewise as the copper developers mentioned hereinbefore a large deposit of cuprous oxide is formed during the reduction and the effect of these solutions is soon lost.

According to U.S. Pat. No. 3,370,721 ascorbic acid is used as a reducing agent in alkaline copper-plating solutions in combination with a sulphite as an anti-oxidant.

According to the invention it was found that one of the redox systems $V^{2+}/V^{3+}$, $Ti^{2+}/Ti^{3+}$, or $Cr^{2+}/Cr^{3+}$, or ascorbic acid in combination with a nitrogen-containing acid acceptor or the oxidation-reduction pair $Fe^{2+}/Fe^{3+}$ in combination with one or more soluble organic carboxylic acids whose cupric salts and iron salts are soluble can successfully be used as a reducing agent for cupric ions to metallic copper in an acid and neutral medium if a complexing agent for cuprous ions is added to the solution and is capable of forming a cuprous complex soluble in water.

These copper-plating solutions may be used both for direct intensification of palladium or platinum nuclei and also of silver amalgam nuclei to internal copper images and for intensifying nuclei to electrically conducting copper patterns.

Said organic carboxylic acids which are used in combination with the $Fe^{2+}/Fe^{3+}$ pair produce a deposit without a complexing agent for cuprous ions. It is true that the citric acid does not yield a deposit in certain cases, but in all cases the addition of a complexing agent for cuprous ions results in a considerable improvement in stability.

Compounds suitable as complexing agents for $Cu^{+}$ ions are 2-butyne-1,4-diol, acetonitrile, ethylenediaminetetra-acetic acid, an alkali sulfite, ammonia, pyridinium-3-sulphonic acid or a phosphonic acid compound.

The latter compounds such as nitrilotrimethyl phosphonic acid, ethylenediaminetetramethylphosphonic acid or ethylenediaminediisopropylphosphonic acid are also complexing agents for cupric ions as described in U.K. Patent Application Ser. No. 74/14,804 not yet published. Ethylenediaminetetra-acetic acid and phosphonic acids are not soluble in a strongly acid medium and are thus not suitable for V and Cr developers. Bisulfite is neither, due to its $SO_2$ development.

As is known per se it is recommended obtaining an extra improvement of the stability to add a cation-active surfactant possibly in combination with a non-ionic surfactant to the copper-plating solution according to the invention. The chosen compound most of course not have a disturbing reaction with the other bath components. A very favourable effect were found to yield quaternary alkylbenzyl or alkyltolylammonium compounds in combination with an alkylarylpolyoxyethylene compound.

The invention will now be described with reference to a number of examples.

EXAMPLE 1

A glass plate having a unilaterally provided cellulose acetobutyrate film of approximately 1.3 μm thick was photosensitized after superficial saponification by soaking it in a solution comprising 0.1 mol of 3,5-dichloro-4-dimethylaminobenzenediazo-tertiarybutylsulphide per liter of ethanol, and drying. The material obtained was exposed behind a stencil for 8 seconds with the aid of a high-pressure mercury lamp HPR125W at a distance of 80 cm. The exposed material was immersed in an aqueous solution comprising 0.005 mol of mercurous nitrate, 0.03 mol of silver nitrate and 0.01 mol of nitric acid per liter so that a silver amalgam nuclei image was produced on the exposed areas. This nuclei image was intensified for 10 minutes with a solution comprising per liter 0.1 mol ascorbic acid
0.15 mol copper nitrate
0.25 mol 2-butyne- 1,4-diol
0.1 mol triethanolamine
0.025% by weight of "Tetrosan"
0.025% by weight of "Lissapol N"

The pH of the developer was 3.68.

"Tetrosan" of Onyx. Chemical Corporation is a mixture consisting for 50% of alkyl ($C_8$–$C_{18}$) dimethyl-3,4-dichlorobenzylammoniumchloride, for 10% of alkanyl ($C_{16}$–$C_{20}$) dimethylethylammoniumbromide and 40% of inert constituents. "Lissapol N" of ICI is nonylphenolpolyoxyethylene. An image having a density of 1.6 was obtained. The developer was free from deposits and/or copper particles during the developing period and also for the following 3 hours and was also quite suitable as a developer.

EXAMPLE 2

A superficially saponified cellulose triacetate foil was photosensitized by immersing it for 1 minute in an aqueous solution comprising per lite 0.15 mol of p-methoxybensenediazosulphonic acid sodium and 0.1 mol of cadmium lactate, rubbing it off between two rubber strips and drying. The photosensitive foil was exposed behind a stencil with the aid of a mercury lamp HPR 125 W at a distance of 50 cm for 5 seconds and subsequently immersed for 2 seconds in an aqueous solution comprising per liter 0.005 mol of mercurous nitrate, 0.03 mol of silver nitrate and 0.01 mol of nitric acid so that an image consisting of silver amalgan nuclei was produced on the exposed areas. The thus obtained "nuclei foil" was rinsed for 5 seconds in deionized water whereafter part of this foil was intensified for 5 minutes to a sufficient final density in one of the following developers comprising per liter:

(a)
- 0.24 mol ascorbic acid
- 0.24 mol copper sulfate
- 0.24 mol triethanolamine (b) solution a+0.16 mol 2-butyne- 1,4-diol (c) solution b+0.02% by weight of "Armac 12D" of Armour Chem. Dov. (consisting for approximately 90% of alkyl ($C_{12}$) aminoacetate with aminoacetates of $C_{14}$ and more as impurities)

(d) solution b+0.02% by weight of "Tetrosan"

(e) solution b+0.03% by weight of cetylpyridiniumchloride.

All developers were adjusted at a pH of 3.40. All surface-active materials were solubilized with "Lissapol N". The lifetime of solution a was 10 minutes in which immediately after composition deposits of cuprous salts and/or oxides were produced. When the experiments were repeated in the same solutions it was found that solution b had a 20 times longer lifetime than solution a while the solutions c to e had a lifetime which was 2 to 20 times the lifetime of solution b. Deposits were not produced in any of the solutions b to e. The 2-butyne-1,4-diol could be replaced by ether cuprous complexing agents without causing a larger instability. These cuprous complexing agents were inter alia ethylenediaminotetramethylphosphonic acid, nitrilodimethylphosphonic acid monoacetic acid, ethyl ethylenediaminetetra acetic acid, pyridinius-3-sulphonic acid, acetonitril, glycol acid nitrile and sodiumbisulfite.

EXAMPLE 3

"Nuclei foils" obtained as in example 2 were intensified in one of the following developer solutions composed as follows:

(a)
- 30 ml of a vanadium (II) solution which was obtained by shaking an aqueous solution comprising per liter 0.2 mol of vanadylsulfate and 0.33 mol of citric acid for 3 hours in a nitrogen atmosphere with an excess of sinc amalgam
- 25 ml of an aqueous solution comprising 0.08% by weight of "Armac 12D" and 0.08% by weight of "Lissapol N"
- 10 ml of an aqueous solution comprising 0.1 mol of $CuSO_4$ per liter
- deionised water to 100 mls.

(b) instead of deionised water, 35 ml of an aqueous solution comprising 8.6 mol of acetonitrile per liter.

After 3 minutes of intensification a cloudy image was obtained with solution a with a density of 2.6. The solution itself was found to be completely unstable after 4 minutes as a result of cuprous oxide deposit. An image having a density of 2.21 was obtained within 3 minutes with solution b; this developer solution itself had a lifetime of more than 20 hours and was completely free from deposits. The development and testing of the lifetime was effected in an $N_2$ atmosphere.

EXAMPLE 4

A 2 μm thick polyester adhesive film provided by means of a handroller, which polyester adhesive was prepared from 45 g terephtalic acid and propyleneglycol in 1,1,2-trichloroethane, 3 g of aluminium-silicate, 3 g if $SiO_2$, 7.5 g of diphenylmethanediisocyanate as a hardener with 255 g of dichloromethane on a 50 μm thick polyethyleneterephtalate foil was photosensitised by seeking it in an aqueous solution prepared by dissolving 28.3 g of e-methoxybenzenediasosulphonic acid sodium, 4.05 g of cadmium carbonate, 2.35 g of calcium carbonate, 7.25 g of lactic acid and 0.05% by weight of "Cellosize WP300" and 0.8% by weight of Lissapol N" in 1 liter of water and by drying the foil. The obtained photosensitive foil was exposed for 1 minute behind a stencil with the aid of a mercury lamp type NPR125W at a distance of 50 cm whereafter the film was immersed in an aqueous solution of 0.05 mol mercurous nitrate, 0.01 mol silver nitrate and 0.1 mol nitric acid per liter so that an image consisting of silver amalgam nuclei was produced on the exposed areas. These nuclei were further intensified in a nitrogen atmosphere in a solution composed as follows:

5 parts by volume of a vanadium (II) solution as described in Example 3 in which instead of 0.33 mol of citric acid 0.5 mol of sulphuric acid had been taken,
2 parts by volume of an aqueous solution comprising 15 mol of acetronitrile per liter
1 part by volume of an aqueous solution comprising 0.1 mol of copper sulphate per liter
2 parts by volume of deionized water After two minutes of intensification a conducting copper image was obtained. "Cellosize WP300" is a hydroxyethylcellulose of Union Carbide.

EXAMPLE 5

Cellulosetriacetate foil was intensified after sensitizing, exposure and nuclei introduction as described in Example 1 in a nitrogen atmosphere with a solution composed as follows:

3 parts by volume of a chromium (II) solution obtained by shaking an aqueous solution comprising 0.1 mol chromium trichloride and 0.33 mol citric acid per liter in a nitrogen atmosphere for 5 hours with an excess of zinc amalgam 1 part by volume of 2-butyne-1,4-diol solution of 10 mol per liter of water 2½ parts by volume of an aqueous solution comprising 0.08% by weight of "Armac 12D" and 0.08% by weight of "Lissapol N" part by volume of an aqueous solution comprising 0.1 mol of copper sulphate per liter 2½ parts by volume of deionized water.

After 10 minutes of intensification a copper image with a density of 1.80 was obtained.

EXAMPLE 6

A plate of anodized aluminium was photosensitized by soaking it for 1 minute in a solution comprising 0.1 mol 4-nitrobenzenediazotertriarybutylsulphide per liter of ethanol, rubbing it off between two rubber strips and drying. After exposure for 10 seconds behind a stencil with the aid of a mercury lamp type NPR125W at a distance of 80 on the plate was immersed in a solution comprising 0.005 mol of mercurous nitrate, 0.01 mol of silver nitrate and 0.01 mol of nitric acid per liter of a mixture of water, ethanol and ethylacetate in the ratio 3:2:1 so that an image consisting of silver amalgam nuclei was formed on the exposed areas. After rinsing in an aqueous solution comprising 1 mol of citric acid per liter the nuclei were intensified in a solution comprising per liter:

0.25 mol ascorbic acid
0.25 mol $CuSO_4$
0.30 mol 2-butyne-1,4-diol
0.25 mol triethanolamine The pH of the developer was 3.67.

After 10 minutes of intensification a conducting fog-free copper image was obtained. The aluminum plate with the copper image could be used as an effect plate.

EXAMPLE 7

Images consisting of amalgam nuclei obtained on glass as in Example 1 were intensified under passage of $N_2$ to sufficient final density at 50° C. for 10 minutes in a solution comprising per liter:

0.03 mol copper sulphate
0.10 mol ferrous ammonium sulphate
0.01 mol ferric nitrate
0.50 mol gluconic acid
0.10 mol sodium bisulfite
0.10% by weight of "Desogen", i.e. the p-methylphenyldodecyltrimethylammonium salt of the firm of Geigy.

The pH of the solution was brought to 6.0 with sodium hydroxide. The solution was completely stable during intensification. Deposits of cuprous salts were produced if no sodium bisulfite was added. When instead of the image of amalgam nuclei glass plates were used which after roughening with HF and carborundum were subsequently treated with a solution of 40 g $SnCl_2$—10 ml HCl—1000 ml water with running deionized water and with a solution of 0.25 g $PdCl_2$—10 ml HCl—1000 ml $H_2O$ satisfactorily conducting copper films were obtained after an intensification of 10 minutes in a nitrogen atmosphere at 30° C. in the abovementioned solution.

EXAMPLE 8

Images consisting of amalgam nuclei according to Example 1 were intensified to a density of more than 2 by treating them under passage of $N_2$ for 10 minutes at 30° C. with a solution comprising per liter 0.03 mol copper sulphate
0.05 mol ferrous ammonium sulphate
0.01 mol ferric nitrate
0.50 mol malonic acid
0.04 mol 2-butyne-1,4-diol
0.05% by weight of "Desogen".

The pH of the solution was brought to 6.0 with NaOH. The solution remained completely stable during intensification. If no 2-butyne-1,4-diol was added cuprous salt deposits were produced.

EXAMPLE 9

Glass plates with images consisting of amalgam nuclei according to Example 1 were intensified to a sufficient final density by treating them under the passage of $N_2$ for 30 minutes at 30° C. with a solution comprising per liter:

0.03 mol copper sulphate
0.10 mol ferrous ammonium sulphate
0.01 mol ferric nitrate
0.10 mol ammonia
0.50 mol citric acid The pH of the solution was adjusted at 7.5. Also this solution remained stable during intensification. If no ammonia was added cuprous salt deposits were produced in the developer solutions.

What is claimed is:

1. An electroless copper-plating solution consisting essentially of an acidic or neutral aqueous solution of cupric ions, a reducing agent capable of reducing said cupric ions to metallic copper and selected from the group consisting of one of the redox pairs $V^{2+}/V^{3+}$, $Ti^{2+}/Ti^{3+}$ or $Cr^{2+}/Cr^{3+}$, a mixture of ascorbic acid and a nitrogen-containing acid acceptor compound capable of neutralizing acid or a mixture of the redox pair $Fe^{2+}/Fe^{3+}$ and at least one water-soluble organic carboxylic acid whose cupric and iron salts are water-soluble and a complexing agent capable of forming a water-soluble cuprous complex with cuprous ions and selected from the group consisting of 2-butyne-1, 3-diol, acetonitrile, pyridinium-3-sulfonic acid, ethylenediamine-tetra-acetic acid ethylenediamine tetramethyl phosphonic acid and ammonia.

2. The electroless copper-plating solution of claim 1 wherein the reducing agent is selected from the group consisting of $V^{2+}/V^{3+}$, $Ti^{2+}/Ti^{3+}$ and $Cr^{2+}/Cr^{3+}$ in an acid medium and the complexing agent is selected from the group consisting of 2-butyne-1, 4-diol and acetonitrile.

3. The electroless copper-plating solution of claim 1 wherein the reducing agent is the redox pair $Fe^{2+}/Fe^{3+}$ in combination with at least one acid selected from the group consisting of malonic acid, citric acid, gluconic acid, tartaric acid and malic acid and the complexing agent is selected from the group consisting of 2-butyne-1,4diol, acetonitrile, pyridinium-3-sulfonic acid and ammonia.

4. The electroless copper-plating solution of claim 1 further containing a non-ionic inert surfactant is present.

* * * * *

UNITED STATES PATENT OFFICE

CERTIFICATE OF CORRECTION

Patent No. 4,248,633 Dated February 3,1981

Inventor(s) Godefridus H.C. Heijnen et al

It is certified that error appears in the above-identified patent and that said Letters Patent are hereby corrected as shown below:

Col. 6, line 49, After "-acetic acid" insert

-- , --

Signed and Sealed this

*Twenty-sixth* Day of *May 1981*

[SEAL]

*Attest:*

RENE D. TEGTMEYER

*Attesting Officer*

*Acting Commissioner of Patents and Trademarks*